US006449849B1

(12) United States Patent
Hackerman

(10) Patent No.: US 6,449,849 B1
(45) Date of Patent: Sep. 17, 2002

(54) SHAVING RAZOR

(76) Inventor: Willard Hackerman, One Slade Ave., Baltimore, MD (US) 21208

( * ) Notice: Subject to any disclaimer, the term of this patent is extended or adjusted under 35 U.S.C. 154(b) by 0 days.

(21) Appl. No.: 09/605,426

(22) Filed: Jun. 29, 2000

(51) Int. Cl.[7] ..... B26B 21/00; B26B 21/54
(52) U.S. Cl. ..... 30/50; 30/32
(58) Field of Search ..... 30/50, 34.1, 527, 30/346.5, 526, 53, 32

(56) References Cited

U.S. PATENT DOCUMENTS

| | | | | |
|---|---|---|---|---|
| 3,740,842 A | | 6/1973 | Bleuer | |
| 3,793,723 A | | 2/1974 | Kuris et al. | |
| 3,828,429 A | | 8/1974 | Hiromura | |
| 3,926,601 A | | 12/1975 | Hicks, Jr. | |
| 4,989,328 A | * | 2/1991 | Sokoloff | 30/34.1 |
| 5,029,390 A | | 7/1991 | Reeves | |
| 5,624,451 A | | 4/1997 | Segal | |
| 5,778,535 A | | 7/1998 | Ledesma | |
| 5,956,848 A | | 9/1999 | Tseng et al. | |
| 5,979,056 A | | 11/1999 | Andrews | |
| 6,032,372 A | | 3/2000 | Dischler | |
| 6,052,905 A | * | 4/2000 | Branchinelli et al. | 30/50 |
| 6,082,007 A | * | 7/2000 | Andrews | 30/53 |
| 6,161,288 A | * | 12/2000 | Andrews | 30/50 |

* cited by examiner

*Primary Examiner*—Douglas D. Watts
(74) *Attorney, Agent, or Firm*—Venable, LLP; George H. Spencer

(57) ABSTRACT

A shaving razor of any of the removable-cartridge type, the pivoting tape, the multiple-blade type and/or the disposable type the multiple-blade type is provided with at least one blade having a width greater than approximately 4.30 cm, and/or the ratio of the width of the blade to a length of a handle is greater than approximately 40.0%.

6 Claims, 9 Drawing Sheets

SHAVING RAZOR

BACKGROUND OF THE INVENTION

The invention relates to a shaving razor for personal use, such as, for example, a men's or ladies'shaving razor.

Shaving razors for personal use have been known in a variety of forms. One type of shaving razor is the so-called "safety razor" which has a generally cylindrical handle and a head perpendicular to the handle that receives a replaceable double-sided blade. The blade has a single edge on one side, and another single edge on an opposite side. When shaving, the user uses only one or the other blade side during a given stroke. Safety razors suffer the disadvantage that they involve a complex mechanical head to removably hold the blade. Also, the blade is difficult to handle during installation and removal of the blade because it is fully exposed during this handling.

Various other shaving razor designs are also known. For example, in so-called "disposable" razors, a plastic handle is non-detachably connected to a plastic razor head that can hold either a single blade or a so-called "multiple blade" (i.e. more than one blade shaving the surface per stroke), such as a "double-blade". A "double-blade" refers to a razor that has two parallel blades having parallel shaving edges that both shave the skin in a single stroke. The handle and head may be integral to each other, or may have a pivoting connection.

Besides the disposable razors, there are also known "cartridge" razors having a handle piece with an attachment means for removable attaching blade cartridges. These blade cartridges are typically plastic assemblies that contain a single-edge blade (having a single blade spanning across); or a multiple blade, such as a double-edge blade (having two parallel blades with parallel shaving edges spanning across, so that both blades shave the surface in a single stroke) or a triple-edge blade (having three parallel blades spanning across with parallel edges so that all three blades shave in a single stroke). The cartridges are removably attached to a handle, avoiding the need to handle the blade itself directly.

The exposed width of the blade in the known detachable cartridge, pivoting head, multiple blade, and disposable-integral shaving razors has generally been a width ranging from approximately 3.40 to 4.30 cm. By "width", is meant the width that is cut by a shaving stroke. This dimension can also be described as the "length" of the blade along its sharp edge.

SUMMARY OF THE INVENTION

It is an object of the invention to provide a shaving razor that provides the advantages of having a relatively wide blade. For example, a wide blade (having a length of the cutting surface longer than in a conventional blade) permits the razor to cover a wider area with each stroke, and therefore shaves more efficiently and much faster than a shorter blade that cuts a narrower width with each stroke. Fewer strokes are required to shave a given area with the invention, so the blade may experience less wear for a given area.

Another object of the invention is to provide a shaving handle and blade apparatus that is extremely convenient and pleasant to use due to the provision of an advantageous ratio between the width of the blade and the length of the handle. Providing a greater width of the blade relative to handle has been found to provide a more desirable "feel" to the operation of the razor.

These objects, and others to be understood from the application, are achieved in one aspect of invention by providing a razor having a handle and a removable blade-holding cartridge, having a blade with a blade width greater than 4.30 cm.

The objects are achieved in another aspect of the invention by providing a shaving razor having a pivoting head element pivotally attached to the razor, having a blade with a blade width greater than 4.30 cm.

The objects are also achieved in an aspect of the invention by providing a razor having multiple parallel blades, with all the blades having a blade width greater than 4.30 cm.

The objects are also achieved in an aspect of the invention by providing a razor having a shaving handle and a non-detachable head for non-removably supporting at least one blade, with the blade having a blade width greater than 4.30 cm.

These objects also are achieved in an aspect of invention by providing a razor having a handle and a removable blade-holding cartridge, with a blade having a width that has a dimension that is at least 40% of the magnitude of the length of the handle.

The objects are achieved in another aspect of the invention by providing a shaving razor having a pivoting head element pivotally attached to the razor, with a blade having a width that has a dimension that is at least 40% of the magnitude of the length of the handle.

The objects are also achieved in an aspect of the invention by providing a razor having multiple parallel blades, with all the blades having a width that has a dimension that is at least 40% of the magnitude of the length of the handle.

These objects is achieved in yet another aspect of the invention by providing a razor having a shaving handle and non-detachable head for non-removably supporting at least one blade, with a blade having a width that has a dimension that is at least 40% of the magnitude of the length of the handle.

DETAILED DESCRIPTION OF THE PREFERRED EMBODIMENTS

Figure 1:
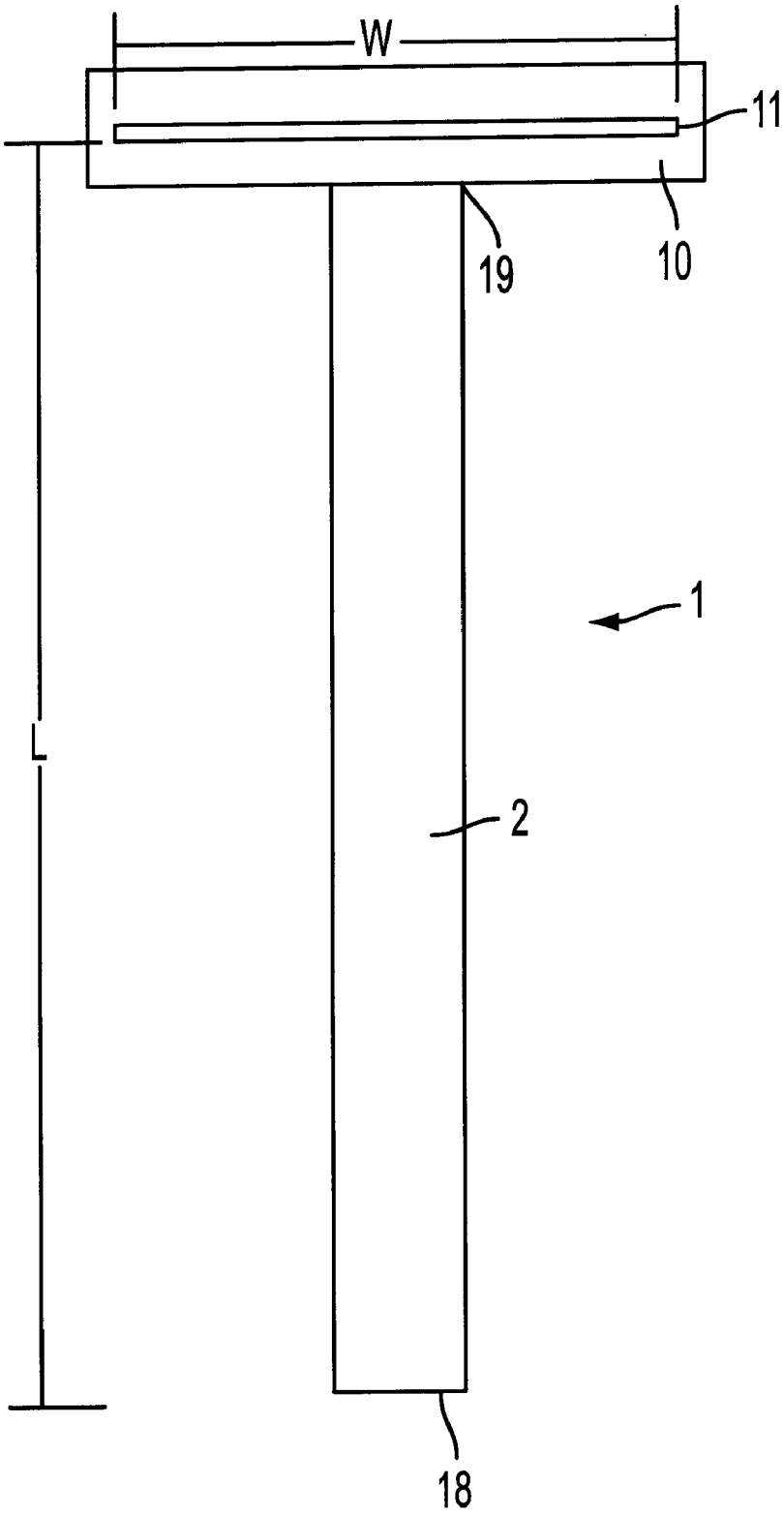
FIG. 1 is a schematic plan view of a razor according to the present invention.

The invention generally relates to a personal shaving razor having a blade with a greater blade width (and hence a greater shaving area width) with each stroke, compared to conventional shaving razors of the detachable-cartridge, pivoting-head, multiple-blade and/or non-detachable head types. Various specific examples are described in detail below, however, it is to be appreciated that the invention can be applied to all other types of detectable-cartridge, pivoting-head, multiple-blade, and/or non-detachable razors.

In the description below, the reference numerals L and L1–L8 are used to describe the length of the handle. Specifically, this dimension is intended to relate to a distance from the lower end of the handle seen in the drawings measured in plan view up to the location of the shaving edge of the lowest blade illustrated in the razor. Therefore, this dimension does necessarily not measure to the attachment point of a cartridge to the handle, nor to the overall length of the handle element with no cartridge present, but rather refers to the length of the handle from its lower end up to the location of the first blade edge. The measurement is taken in a plan view (i.e., with the handle lying generally in the plane of the illustration).

FIG. 1 schematically depicts a razor 1 according to an embodiment of the invention, having a handle 2, blade head 10, blade 11, and connection area 19. In some embodiments, the width W of the exposed blade(s) is preferably greater than approximately 4.30 cm (centimeters), and preferably between approximately 4.68 cm and approximately 7.00 cm, and/or the length L measured in plan from the edge of the blade 11 to the lower end 18 of the handle 2 is preferably such that the blade width W of the blade is greater than handle approximately 40% of the length L, preferably with the blade width W being in a range between 40% and 61.4% of the handle length L.

Figure 2:
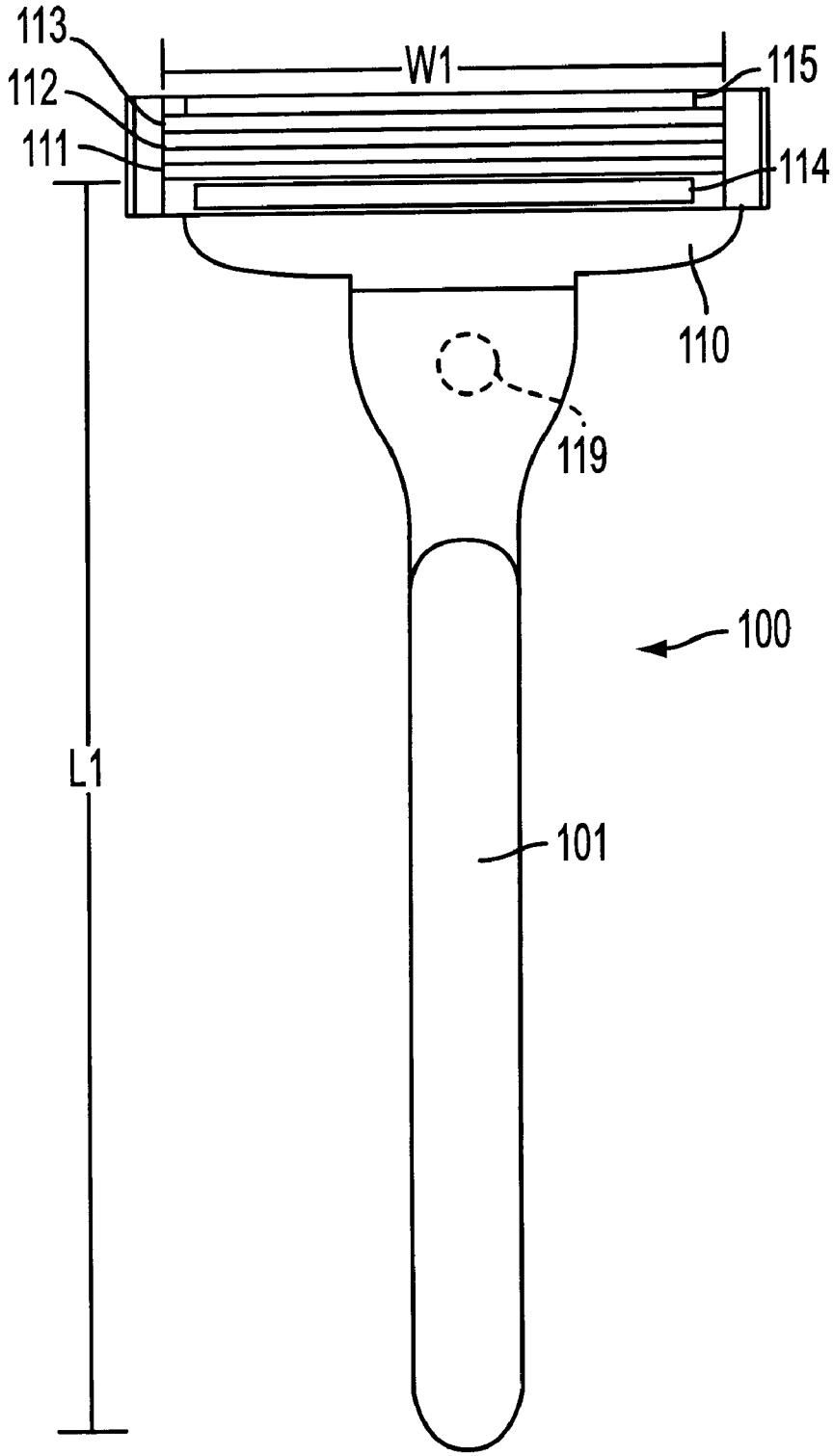
FIGS. 2 through 8 are plan views of various embodiments of a shaving razor according to the present invention.

FIG. 2 illustrates a preferred embodiment of a razor 100 according to the present invention. The razor includes a handle 101 (similar one sold as the GILLETTE MACH III™), and a blade holding cartridge 110 (similar to the cartridge sold as the GILLETTE MACH III™ but with a greater width) that is detachable from the handle 101. The cartridge 110 includes three parallel blades 111, 112, 113 mounted in a resilient arrangement in the cartridge 110. The cartridge also includes a segment 114 with resilient fins, and a strip 115 including lubricating material. The cartridge 110 can be attached to and detached from the handle 101 by means of a manual latch 119. The cartridge 110 includes a pivot to permit a part of the cartridge 110 holding the blades 111, 112, 113 to pivot relative to the handle 101. In a preferred embodiment, the length L1 of the handle 101 is approximately 12.60 cm. A preferred width W1 of the blades is approximately 5.10 cm. This width may be varied, and a preferred range of widths W1 is between approximately 4.68 cm and approximately 5.53 cm, although any width greater than approximately 4.30 cm is also preferred. Accordingly, a preferred ratio of the width W1 of the blades is approximately 40.5% to the length L1 of the handle. This ratio may be varied in a preferred range for the width W1 of the blades, although any ratio greater than approximately 40% is preferred.

Figure 3:
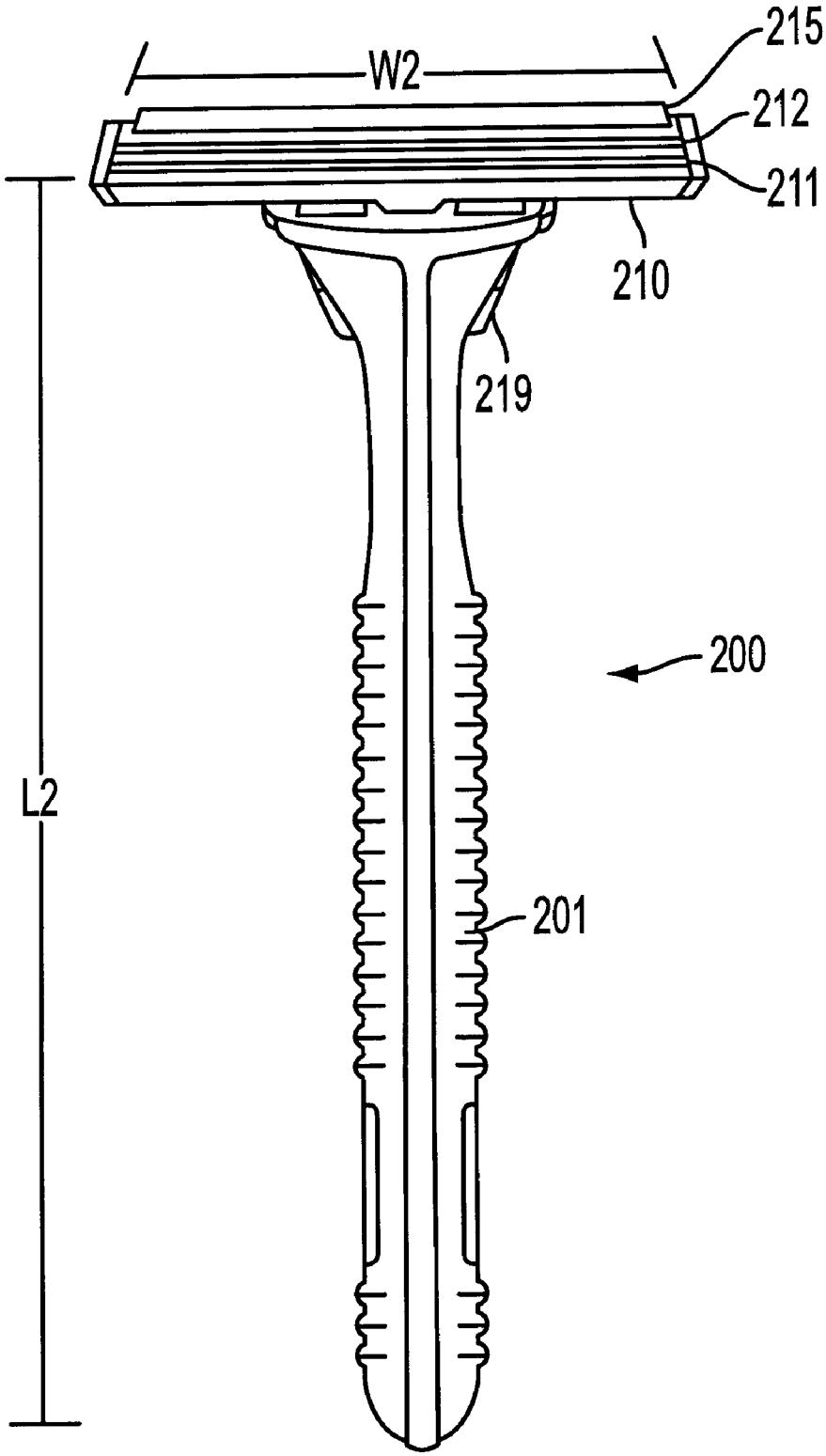

FIG. 3 illustrates a preferred embodiment of a razor 200 according to the present invention. The razor includes a handle 201 (similar to one sold as GILLETTE SENSOR™) and a blade holding cartridge 210 (similar to that sold as GILLETTE SENSOR™ but with a greater width) that is detachable from the handle 201. The cartridge 210 includes two parallel blades 211, 212 mounted in a resilient arrangement in the cartridge 210. The cartridge also includes a segment 214 with fins, and a strip 215 including lubricating material. The cartridge 210 can be attached and detached relative to the handle 201 by means of a manual latch 219. The cartridge fits 210 on the latch 219 so that the entire cartridge 210 pivots relative to the handle 201. In a preferred embodiment, the length L2 of the handle 201 is approximately 12.0 cm. A preferred width W2 of the blades is approximately 5.1 cm. This width may be varied, and a preferred range of widths W2 is between approximately 4.68 cm and approximately 5.53 cm, although any width greater than approximately 4.30 cm is also preferred. Accordingly, a preferred ratio of the width W2 of the blades is approximately 42.5% to the length L2 of the handle. This ratio may be varied in a preferred range for the width W2 of the blades relative to the length L2 of the handle, although any ratio greater than approximately 40% is preferred.

Figure 4:
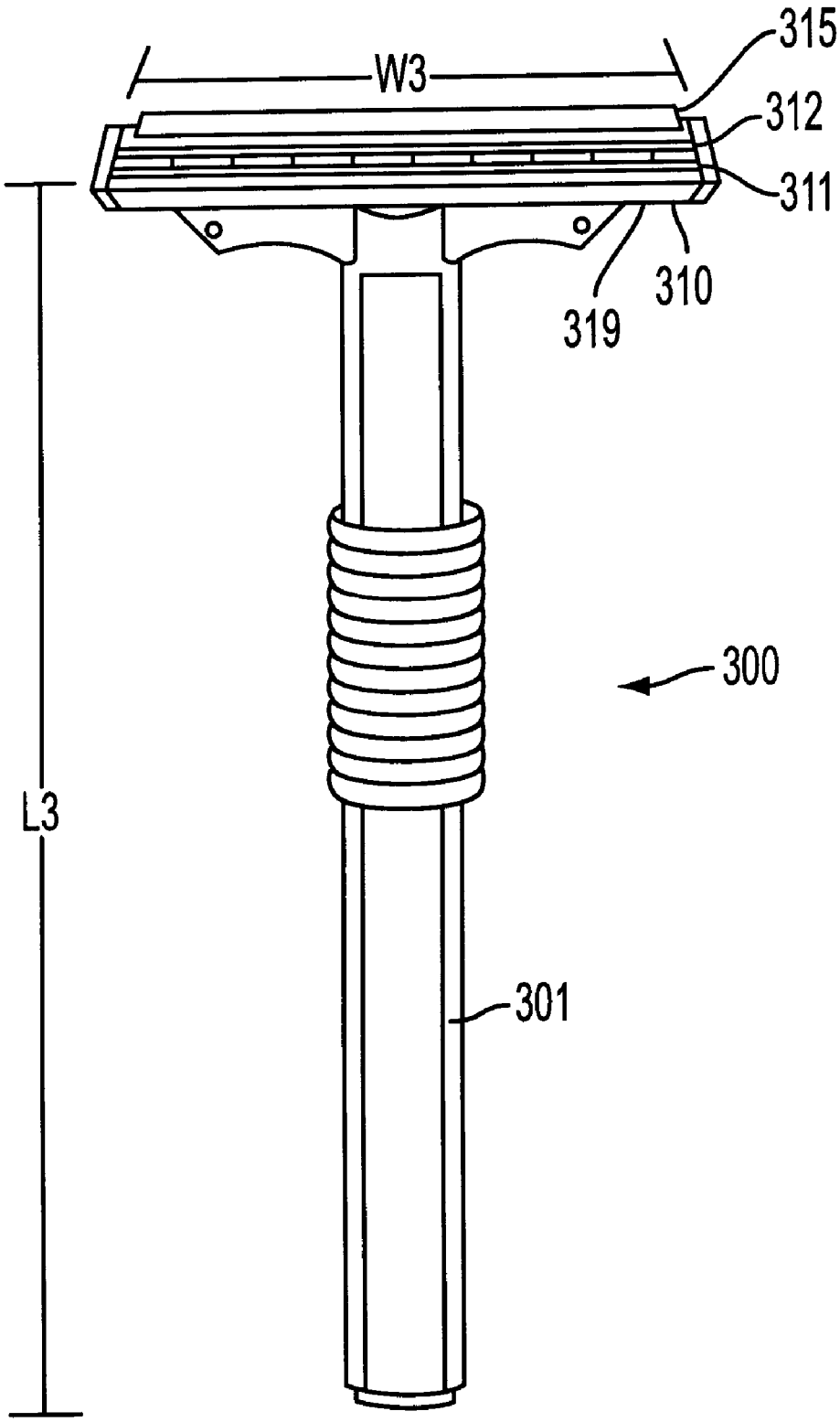

FIG. 4 illustrates a preferred embodiment of a razor 300 according to the present invention. The razor includes a handle 301 (similar one sold as GILLETTE ATRA PLUSH™) and a blade holding cartridge 310 (similar to one sold as GILLETTE ATRA PLUS™ but with a greater width), that is detachable from the handle 301. The cartridge 310 includes two parallel blades 311, 312 mounted in the cartridge 110. The cartridge also includes a strip 315 including lubricating material. The cartridge 310 can be attached and detached relative to the handle 301 by means of a manual latch 319. The entire cartridge 310 can pivot relative to the handle 301. In a preferred embodiment, the length L3 of the handle W3 is approximately 11.4 cm. A preferred width W3 of the blades is approximately 5.60 cm. This width may be varied, and a preferred range of widths W3 is between approximately 5.13 cm and approximately 6.06 cm although any width greater than 4.30 cm is also preferred. Accordingly, a preferred ratio of the width W3 of the blades is approximately 49.1% to the length L1 of the handle. This ratio may be varied in a preferred range for the width W3 of the blades relative to the length L3 of the handle, although any ratio greater than approximately 40% is preferred.

Figure 5:
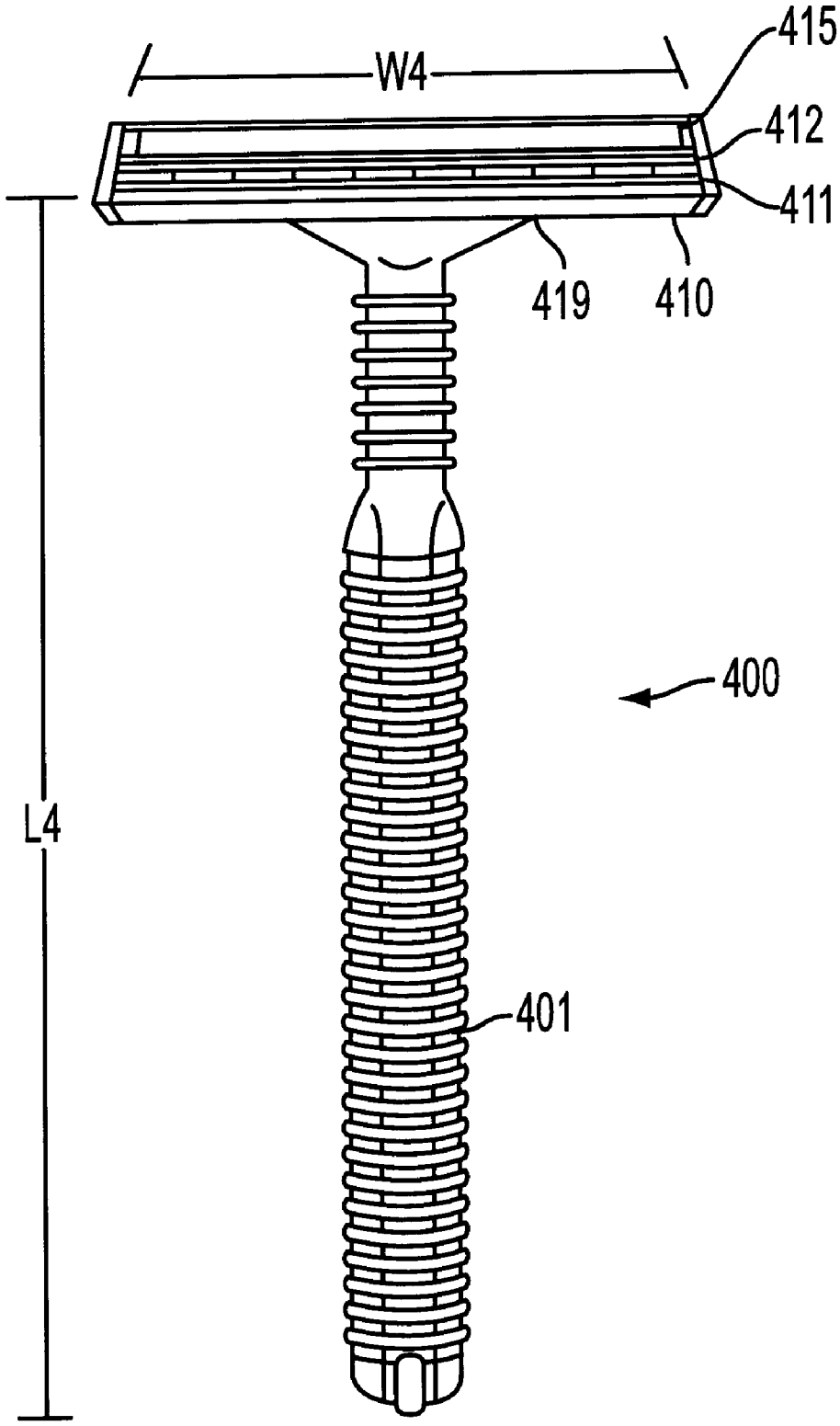

FIG. 5 illustrates a preferred embodiment of a razor 400 according to the present invention. The razor includes a handle 401 (similar to one sold as GILLETTE TRAC II PLUS™) and a blade holding cartridge 410 (similar to one sold as GILLETTE TRAC II PLUS™ but with a greater width) that is detachable from the handle 401. The cartridge 410 includes two parallel blades 411, 412 mounted in the cartridge 410. The cartridge also includes a strip 415 including lubricating material. The cartridge 410 can be attached and detached relative to the handle 401 by means of being slid onto a receiving portion 419 of the handle 401, and does not pivot. In a preferred embodiment, the length of the handle L4 is approximately 11.4 cm. A preferred width W4 of the blades is approximately 5.40 cm. This width may be varied, and a preferred range of widths W4 is between approximately 4.95 cm and approximately 5.85 cm although any width greater than approximately 4.30 cm is also preferred. Accordingly, a preferred ratio of the width W4 of the blades is approximately 47.4% to the length L4 of the handle. This ratio may be varied in a preferred range for the width W4 of the blade relative to the length L4 of the handle, although any ratio greater than approximately 40% is preferred.

Figure 6:
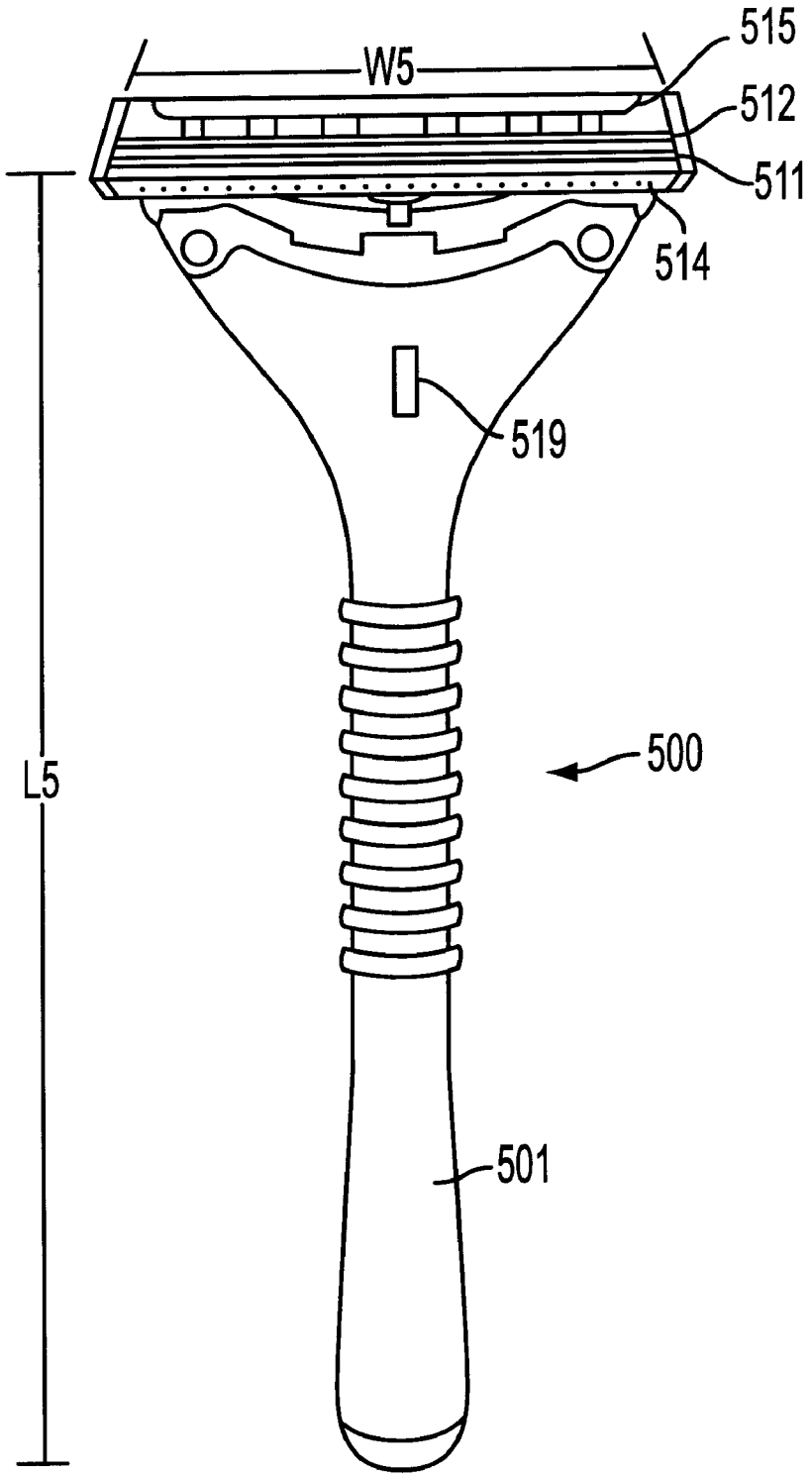

FIG. 6 illustrates a preferred embodiment of a razor 500 according to the present invention. The razor includes a handle 501 (similar to one sold as SCHICK FX DIAMOND™) and a blade holding cartridge 510 (similar to one sold as SCHICK FX DIAMOND™ but with a greater width) that is detachable from the handle 501. The cartridge 510 includes two parallel blades 511, 512 mounted in a flexible arrangement in the cartridge 510. The cartridge also includes a segment 514 with shaped areas and a strip 515 including lubricating material. The cartridge 510 can be attached and detached relative to the handle 501 by means of a manual latch 519. In a preferred embodiment, the length of the handle L5 is approximately 12.6 cm. A preferred width L5 of the blades is approximately 5.40 cm. This width may be varied, and a preferred range of widths W5 is between approximately 4.95 cm and approximately 5.85 cm although any width greater than approximately 4.30 cm is also preferred. Accordingly, a preferred ratio of the width W5 of the blades is approximately 42.8% to the length L1 of the handle. This ratio may be varied in a preferred range for the width W5 of the blades relative to the length L5 of the handle, although any ratio greater than approximately 40% is preferred.

Figure 7:
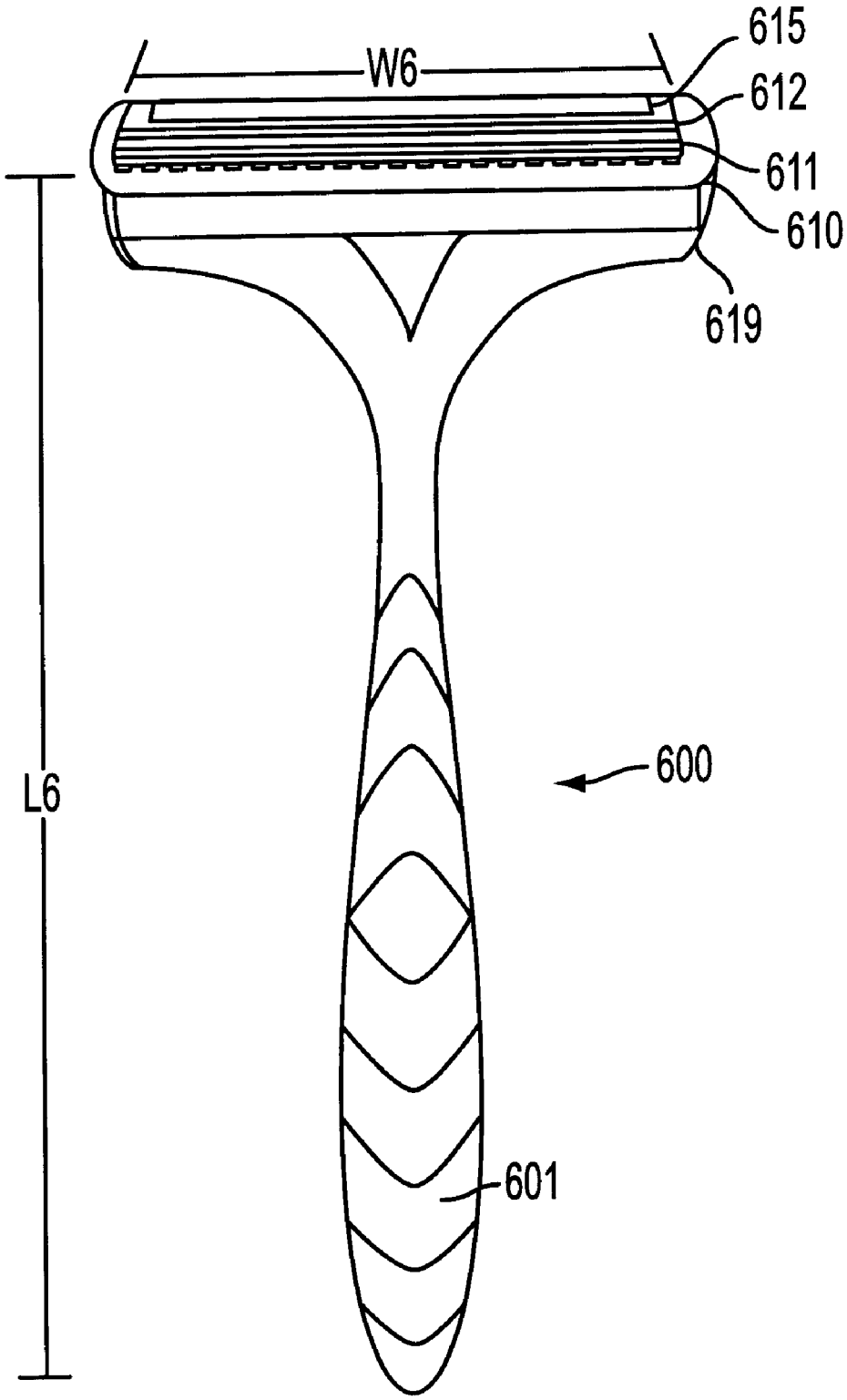

FIG. 7 illustrates a preferred embodiment of a razor 600 according to the present invention. The razor includes a handle 601 (similar to one sold as SCHICK PERSONAL TOUCH™)and a blade holding cartridge 610 (similar to one sold as SCHICK PERSONAL TOUCH™ but with a greater width) that is detachable from the handle 601. The cartridge 610 includes two parallel blades 611, 612 mounted in the cartridge 610. The cartridge also includes a segment 614 with teeth and a strip 615 including lubricating material. The cartridge 610 can be attached and detached relative to the handle 601 by means of being slid on a receiving portion 619 of the handle. The blade does not pivot relative to the handle. In a preferred embodiment, the length of the handle L6 is approximately 11.6 cm. A preferred width W6 of the blade is approximately 5.18 cm. This width may be varied, and a preferred range of widths W6 is between approximately 4.74 cm and approximately 5.61 cm although any width greater than approximately 4.30 cm is also preferred. Accordingly, a preferred ratio width of the blade is approximately 44.6% to the length L1 of the handle. This ratio may be varied in a preferred range for the width W6 of the blade relative to the length L6 of the handle, although any ratio greater than approximately 40% is preferred.

Figure 8:
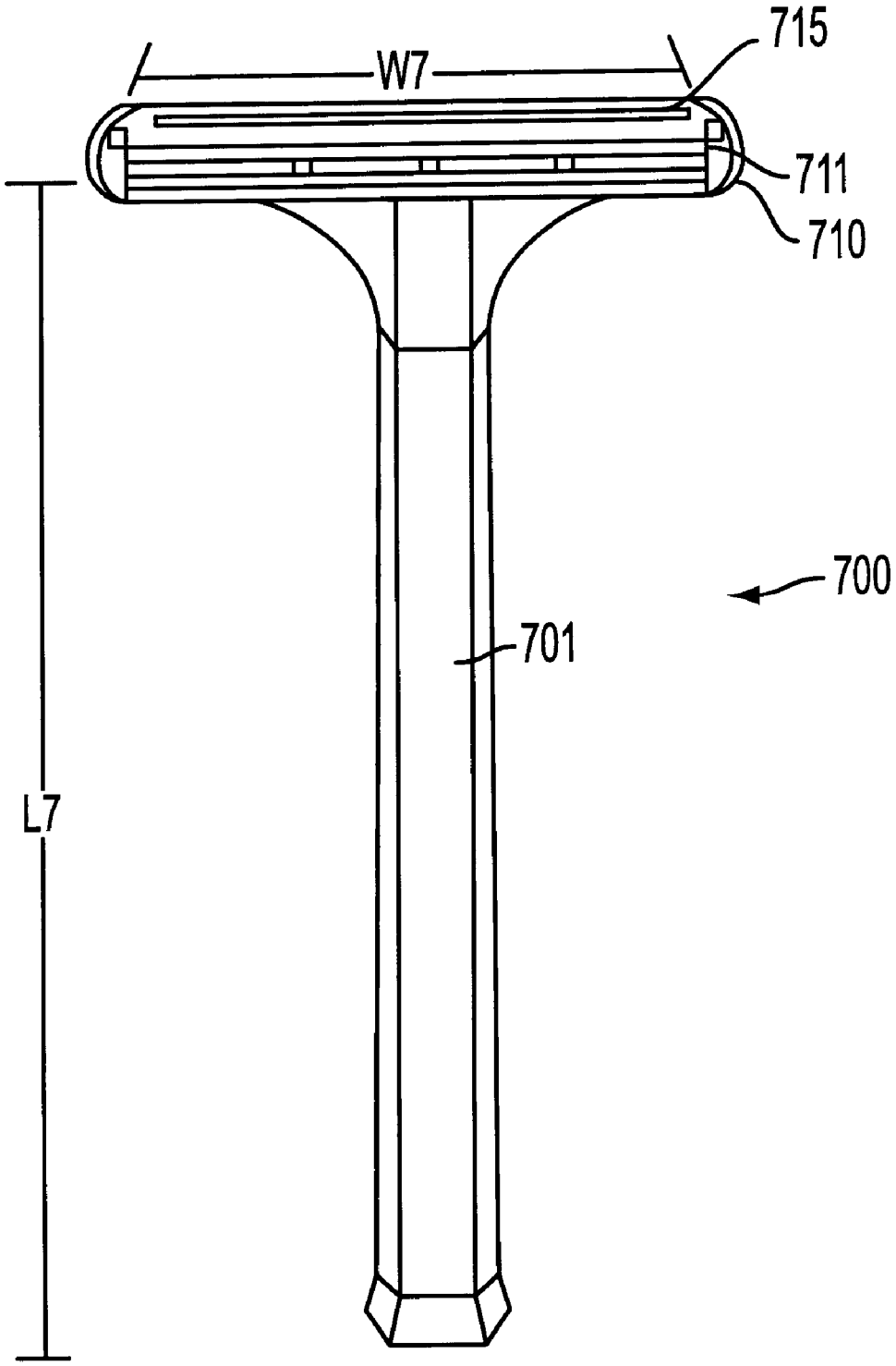

FIG. 8 illustrates a preferred embodiment of a razor 700 according to the present invention. The razor includes a handle 701 (similar to one sold as BIC PLUS™) and a head 710 (similar to one sold as BIC PLUS™ but with a greater width) that is integral with the handle 701. The head 710 includes one blade 711 mounted non-removably in a head 710. As used herein, "non-removable head element" refers to a head element that is designed not to be removed from the handle by the user, with a blade mounted in the head element so that the blade is designed not to be removed from the head element by the user. Returning to the embodiment of FIG. 8, the head also includes a strip 715 including lubricating material. The head 710 is integral with the handle 701 and does not pivot. In a preferred embodiment, the length L7 of the handle 701 is approximately 11.0 cm. A preferred width W7 of the blade is approximately 5.10 cm. This width may be varied, and a preferred range of widths W1 is between approximately 4.68 cm and approximately 5.53 cm although any width greater than approximately 4.30 cm is also preferred. Accordingly, a preferred ratio width W7 of the blade is approximately 41.3% to the length L7 of the handle. This ratio may be varied in a preferred range for the width W7 of the blade relative to the length L7 of the handle, although any ratio greater than approximately 40% is preferred.

Figure 9:
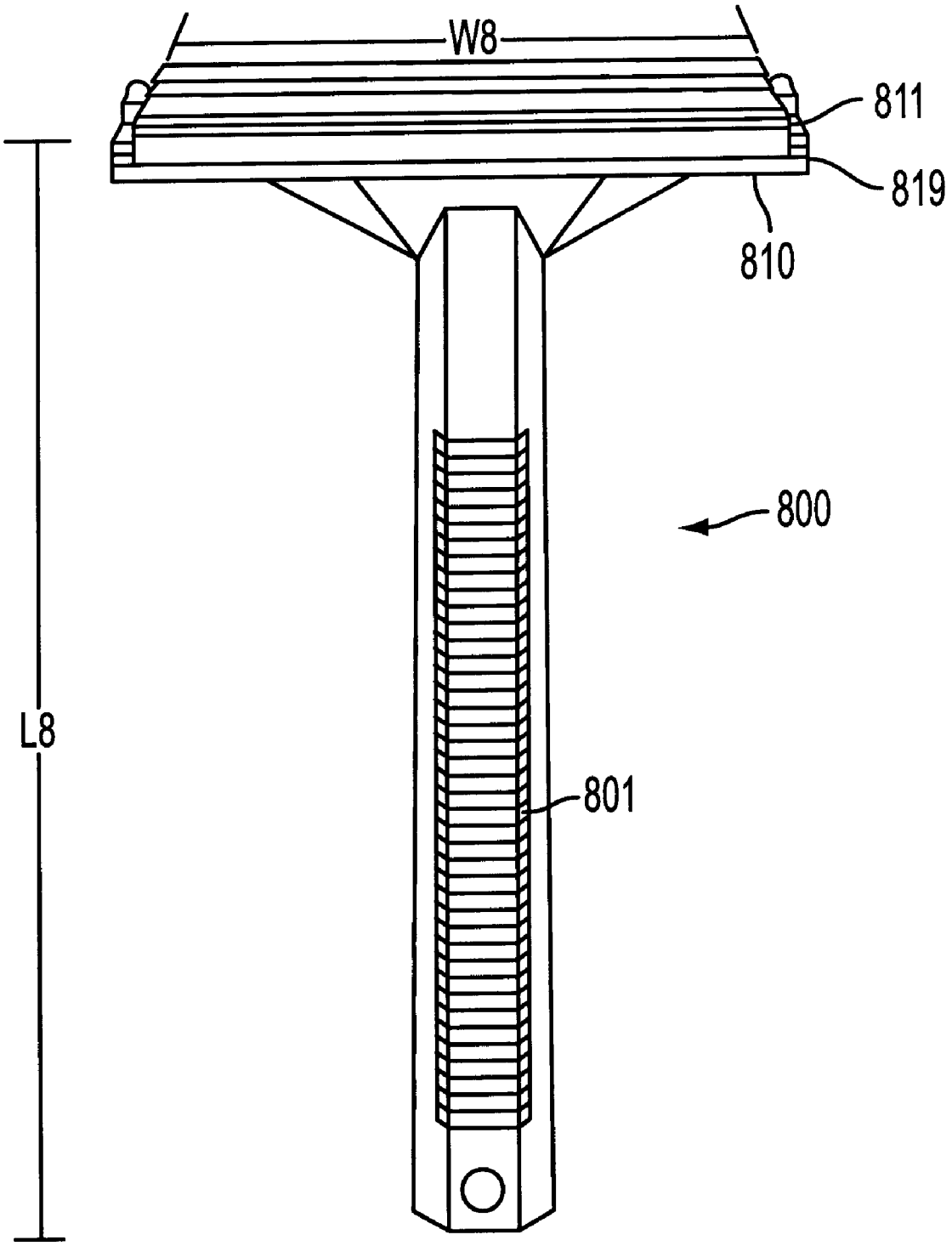

FIG. 9 illustrates a preferred embodiment of a razor 810 according to the present invention. The razor includes a handle 801 (similar to one sold as WILKINSON SWORD™) and a blade head 810 (similar to one sold as WILKINSON SWORD™ but with a greater width) that is integral with the handle 801. The cartridge 810 includes one blade 811 mounted in the head 810. The cartridge 810 fits in a mounting portion 819 of the handle, and is detachable. The head 810 does not pivot. In a preferred embodiment, the length of the handle L8 is approximately 10.5 cm. A preferred width W8 of the blade is approximately 6.45 cm. This width may be varied, and a preferred range of widths W8 is between approximately 5.91 cm and approximately 6.99 cm, although any width greater than approximately 4.30 cm is also preferred. Accordingly, a preferred ratio width of the blade is approximately 61.4% to the length L8 of the handle. This ratio may be varied in a preferred range for the width W8 of the blade relative to the length L8 of the handle, although any ratio greater than approximately 40% is preferred.

Besides the various embodiments detailed described above, many modifications are possible. For example, the handles are shown as being generally elongated, but other handle shapes including wider or flatter handles are possible.

It will be understood that the above description of the present invention is susceptible to various modifications, changes and adaptations, and the same are intended to be comprehended with the meaning and range of equivalents of the appended claims.

What is claimed is:

1. A shaving razor comprising a handle and a head attached to the handle and being perpendicular thereto said head having at least one blade the width of which is approximately 7.00 cm, said width being greater than approximately 40% of length of handle end to said blade.

2. A shaving razor as defined in claim 1, wherein said head has two generally parallel blades of substantially the same length.

3. A shaving razor as defined in claim 1, when said head is pivotally attached to said handle.

4. A shaving razor as defined in claim 1, when said head is removably attached to said handle.

5. A shaving razor as defined in claim 1, wherein said head is non-removably attached to said handle.

6. A shaving razor as defined in claim 1, where said head is integral with said handle.

* * * * *